US006091387A

United States Patent [19]

Ueno et al.

[11] Patent Number: 6,091,387

[45] Date of Patent: Jul. 18, 2000

[54] LIQUID CRYSTAL DISPLAY DEVICE AND DRIVING METHOD OF THE SAME

[75] Inventors: Satoshi Ueno, Yamatokoriyama; Kunihiko Yamamoto, Kashiba, both of Japan

[73] Assignee: Sharp Kabushiki Kaisha, Osaka, Japan

[21] Appl. No.: 08/941,988

[22] Filed: Oct. 1, 1997

[30] Foreign Application Priority Data

Oct. 4, 1996 [JP] Japan ..... 8-264925

[51] Int. Cl.[7] ..... G09G 3/36

[52] U.S. Cl. ..... 345/89; 345/148; 345/100

[58] Field of Search ..... 345/87, 103, 94, 345/99, 98, 100, 147, 148, 89

[56] References Cited

U.S. PATENT DOCUMENTS

| | | | |
|---|---|---|---|
| 5,010,326 | 4/1991 | Yamazaki et al. . | |
| 5,119,085 | 6/1992 | Yamazaki . | |
| 5,159,326 | 10/1992 | Yamazaki et al. . | |
| 5,175,535 | 12/1992 | Yamazaki et al. . | |
| 5,179,371 | 1/1993 | Yamazaki . | |
| 5,184,118 | 2/1993 | Yamazaki . | |
| 5,214,417 | 5/1993 | Yamazaki . | |
| 5,262,881 | 11/1993 | Kuwata et al. . | |
| 5,298,914 | 3/1994 | Yamazaki . | |
| 5,442,370 | 8/1995 | Yamazaki et al. . | |
| 5,485,173 | 1/1996 | Scheffer et al. . | |
| 5,815,132 | 9/1998 | Okada et al. | 345/95 |
| 5,828,357 | 10/1998 | Tamai et al. | 345/89 |
| 5,844,534 | 12/1998 | Okumura et al. | 345/90 |
| 5,877,738 | 3/1999 | Ito et al. | 345/94 |

FOREIGN PATENT DOCUMENTS

| | | |
|---|---|---|
| 6-4049 | 1/1994 | Japan . |
| 8-146382 | 6/1996 | Japan . |

*Primary Examiner*—Lun-Yi Lao
*Assistant Examiner*—Vanel Frenel
*Attorney, Agent, or Firm*—Nixon Vanderhye P.C.

[57] ABSTRACT

A driving method of a liquid crystal display device of a matrix type including a plurality of scanning electrodes and a plurality of data electrodes is provided. Certain scanning electrodes are simultaneously selected and driven. A correction voltage is added to a scanning signal to be supplied to the certain scanning electrodes.

13 Claims, 17 Drawing Sheets w : Total length of right and left black bars (number of dots)

Conventional driving

Driving according to the present invention

1H=21.9
Tk1=2.2
Th1=6.6
Th2=8.8
Ts=1.1
Tk2=3.3
(unit:μs)

Vs1=29.1
Vs2=1.05*Vs1=30.6
(unit:V)

Shift register (SR)
Blank (blank)
Function (W)
Correction signal (H1)
Correction signal (H0)
51
51a
51b
51c
51d
51e
51f
51g
51h
51i
51j
51k
51l
51m
51n
51o
51p
51q
51r
51s
51t
VH4
VH3
VH2
VH1
Vcom
VL1
VL2
VL3
VL4
Output VSS ≤ VL4 ≤ VL3 ≤ VL2 ≤ VL1 ≤ Vcom ≤ VH1 ≤ VH2 ≤ VH3 ≤ VH4

*FIG. 14*

1 frame TF

| | | | | | | | | | | | | | | | | |
|---|---|---|---|---|---|---|---|---|---|---|---|---|---|---|---|---|
| F1 | 1 | 1 | 1 | 1 | 1 | 1 | 1 | 1 | 1 | 1 | 1 | 1 | 1 | 1 | 1 | 1 |
| F2 | 1 | -1 | 1 | -1 | 1 | -1 | 1 | -1 | 1 | -1 | 1 | -1 | 1 | -1 | 1 | -1 |
| F3 | 1 | 1 | -1 | -1 | 1 | 1 | -1 | -1 | 1 | 1 | -1 | -1 | 1 | 1 | -1 | -1 |
| F4 | 1 | -1 | -1 | 1 | 1 | -1 | -1 | 1 | 1 | -1 | -1 | -1 | 1 | -1 | -1 | 1 |
| F5 | 1 | 1 | 1 | 1 | -1 | -1 | -1 | -1 | 1 | 1 | 1 | 1 | -1 | -1 | -1 | -1 |
| F6 | 1 | -1 | 1 | -1 | -1 | 1 | -1 | 1 | 1 | -1 | 1 | -1 | -1 | 1 | -1 | 1 |
| F7 | 1 | 1 | -1 | -1 | -1 | -1 | 1 | 1 | 1 | 1 | -1 | -1 | -1 | -1 | 1 | 1 |
| F8 | 1 | -1 | -1 | 1 | -1 | 1 | 1 | -1 | 1 | -1 | -1 | -1 | 1 | -1 | 1 | -1 |
| F9 | 1 | 1 | 1 | 1 | 1 | 1 | 1 | 1 | -1 | -1 | -1 | -1 | -1 | -1 | -1 | -1 |
| F10 | 1 | -1 | 1 | -1 | 1 | -1 | 1 | -1 | -1 | 1 | -1 | 1 | -1 | 1 | -1 | 1 |
| F11 | 1 | 1 | -1 | -1 | 1 | 1 | -1 | -1 | -1 | -1 | 1 | 1 | -1 | -1 | 1 | 1 |
| F12 | 1 | -1 | -1 | 1 | 1 | -1 | -1 | 1 | -1 | 1 | 1 | -1 | -1 | 1 | 1 | -1 |
| F13 | 1 | 1 | 1 | 1 | -1 | -1 | -1 | -1 | -1 | -1 | -1 | -1 | -1 | 1 | 1 | 1 |
| F14 | 1 | -1 | 1 | -1 | -1 | 1 | -1 | 1 | -1 | 1 | -1 | 1 | 1 | -1 | 1 | -1 |
| F15 | 1 | 1 | -1 | -1 | -1 | -1 | 1 | 1 | -1 | -1 | 1 | 1 | 1 | 1 | -1 | -1 |
| F16 | 1 | -1 | -1 | 1 | -1 | 1 | 1 | -1 | -1 | 1 | 1 | -1 | 1 | -1 | -1 | 1 |

*FIG. 15*

1 frame TF

| | | | | | | | | | | | | | | | | |
|---|---|---|---|---|---|---|---|---|---|---|---|---|---|---|---|---|
| F1 | 1 | 0 | 0 | 0 | 1 | 0 | 0 | 0 | 1 | 0 | 0 | 0 | 1 | 0 | 0 | 0 |
| F2 | 1 | 0 | 0 | 0 | -1 | 0 | 0 | 0 | 1 | 0 | 0 | 0 | -1 | 0 | 0 | 0 |
| F3 | 1 | 0 | 0 | 0 | 1 | 0 | 0 | 0 | -1 | 0 | 0 | 0 | -1 | 0 | 0 | 0 |
| F4 | 1 | 0 | 0 | 0 | -1 | 0 | 0 | 0 | -1 | 0 | 0 | 0 | 1 | 0 | 0 | 0 |
| F5 | 0 | 1 | 0 | 0 | 0 | 1 | 0 | 0 | 0 | 1 | 0 | 0 | 0 | 1 | 0 | 0 |
| F6 | 0 | 1 | 0 | 0 | 0 | -1 | 0 | 0 | 0 | 1 | 0 | 0 | 0 | -1 | 0 | 0 |
| F7 | 0 | 1 | 0 | 0 | 0 | 1 | 0 | 0 | 0 | -1 | 0 | 0 | 0 | -1 | 0 | 0 |
| F8 | 0 | 1 | 0 | 0 | 0 | -1 | 0 | 0 | 0 | -1 | 0 | 0 | 0 | 1 | 0 | 0 |
| F9 | 0 | 0 | 1 | 0 | 0 | 0 | 1 | 0 | 0 | 0 | 1 | 0 | 0 | 0 | 1 | 0 |
| F10 | 0 | 0 | 1 | 0 | 0 | 0 | -1 | 0 | 0 | 0 | 1 | 0 | 0 | 0 | -1 | 0 |
| F11 | 0 | 0 | 1 | 0 | 0 | 0 | 1 | 0 | 0 | 0 | -1 | 0 | 0 | 0 | -1 | 0 |
| F12 | 0 | 0 | 1 | 0 | 0 | 0 | -1 | 0 | 0 | 0 | -1 | 0 | 0 | 0 | 1 | 0 |
| F13 | 0 | 0 | 0 | 1 | 0 | 0 | 0 | 1 | 0 | 0 | 0 | 1 | 0 | 0 | 0 | 1 |
| F14 | 0 | 0 | 0 | 1 | 0 | 0 | 0 | -1 | 0 | 0 | 0 | 1 | 0 | 0 | 0 | -1 |
| F15 | 0 | 0 | 0 | 1 | 0 | 0 | 0 | 1 | 0 | 0 | 0 | -1 | 0 | 0 | 0 | -1 |
| F16 | 0 | 0 | 0 | 1 | 0 | 0 | 0 | -1 | 0 | 0 | 0 | -1 | 0 | 0 | 0 | 1 |

1 frame TF

T

L

| | | | | | | | | | | | | | | | | |
|---|---|---|---|---|---|---|---|---|---|---|---|---|---|---|---|---|
| F1 | 1 | 0 | 1 | 0 | 0 | 0 | 0 | 0 | 0 | 0 | 0 | 0 | 0 | 0 | 0 | 0 |
| F2 | 1 | 0 | −1 | 0 | 0 | 0 | 0 | 0 | 0 | 0 | 0 | 0 | 0 | 0 | 0 | 0 |
| F3 | 0 | 1 | 0 | 1 | 0 | 0 | 0 | 0 | 0 | 0 | 0 | 0 | 0 | 0 | 0 | 0 |
| F4 | 0 | 1 | 0 | −1 | 0 | 0 | 0 | 0 | 0 | 0 | 0 | 0 | 0 | 0 | 0 | 0 |
| F5 | 0 | 0 | 0 | 0 | 1 | 0 | 1 | 0 | 0 | 0 | 0 | 0 | 0 | 0 | 0 | 0 |
| F6 | 0 | 0 | 0 | 0 | 1 | 0 | −1 | 0 | 0 | 0 | 0 | 0 | 0 | 0 | 0 | 0 |
| F7 | 0 | 0 | 0 | 0 | 0 | 1 | 0 | 1 | 0 | 0 | 0 | 0 | 0 | 0 | 0 | 0 |
| F8 | 0 | 0 | 0 | 0 | 0 | 1 | 0 | −1 | 0 | 0 | 0 | 0 | 0 | 0 | 0 | 0 |
| F9 | 0 | 0 | 0 | 0 | 0 | 0 | 0 | 0 | 1 | 0 | 1 | 0 | 0 | 0 | 0 | 0 |
| F10 | 0 | 0 | 0 | 0 | 0 | 0 | 0 | 0 | 1 | 0 | −1 | 0 | 0 | 0 | 0 | 0 |
| F11 | 0 | 0 | 0 | 0 | 0 | 0 | 0 | 0 | 0 | 1 | 0 | 1 | 0 | 0 | 0 | 0 |
| F12 | 0 | 0 | 0 | 0 | 0 | 0 | 0 | 0 | 0 | 1 | 0 | −1 | 0 | 0 | 0 | 0 |
| F13 | 0 | 0 | 0 | 0 | 0 | 0 | 0 | 0 | 0 | 0 | 0 | 0 | 1 | 0 | 1 | 0 |
| F14 | 0 | 0 | 0 | 0 | 0 | 0 | 0 | 0 | 0 | 0 | 0 | 0 | 1 | 0 | −1 | 0 |
| F15 | 0 | 0 | 0 | 0 | 0 | 0 | 0 | 0 | 0 | 0 | 0 | 0 | 0 | 1 | 0 | 1 |
| F16 | 0 | 0 | 0 | 0 | 0 | 0 | 0 | 0 | 0 | 0 | 0 | 0 | 0 | 1 | 0 | −1 |

Hatched-line portion : black block
Background : white

LIQUID CRYSTAL DISPLAY DEVICE AND DRIVING METHOD OF THE SAME

BACKGROUND OF THE INVENTION

1. Field of the Invention

The present invention relates to a liquid crystal display device such as a matrix liquid crystal display device used for various types of office automation apparatus such as a personal computer and a wordprocessor, multi-media information terminals, AV apparatus, game machines, and the like, and a driving method of such a liquid crystal display device.

2. Description of the Related Art

A simple matrix liquid crystal display device using twisted nematic (TN) liquid crystal and super twisted nematic (STN) liquid crystal which respond to an effective voltage is known. Such a simple matrix liquid crystal display device includes a liquid crystal panel having scanning electrodes and data electrodes crossing each other with liquid crystal therebetween. The simple matrix liquid crystal display device is driven by a line-sequential driving method.

In the line-sequential driving method, a scanning signal is applied to the scanning electrodes so as to sequentially select the scanning electrodes one by one. In synchronization with the selection of the scanning electrodes, a signal corresponding to display data for pixels on the selected scanning electrode is applied to the data electrodes.

In recent years, with the increasing request for display of multi-media information, the simple matrix liquid crystal display device using STN liquid crystal has been required to display video images and images for amusement. To meet this requirement, the display quality of the device should be improved.

In order to improve the display quality, the number of scanning lines of a liquid crystal panel may be increased. However, in the liquid crystal display device with high-speed response employing the aforementioned conventional line-sequential driving method, when the number of scanning lines is increased, a "frame response phenomenon" becomes significant, where the transmittance of the device does not respond to the effective voltage but to a driving waveform itself. Thus causes the transmittance to vary every frame and thus lowers the brightness of the device.

In order to overcome the above problem, the following three driving methods have been proposed.

(1) An active addressing (AA) method, where a WALSH function or the like is used as an orthogonal function. As shown in FIG. 14, a positive or negative voltage (1 or −1) obtained from this function is applied to all scanning electrodes (F1 to F16) simultaneously so that the orthogonality is established within one frame period TF, i.e., the inner product of a row vector is equal to zero. (T. J. Scheffer et al., SID '92, Digest, p. 228; Japanese Publication No. 7-120147; etc.)

(2) A sequency addressing (SAT) method, where one frame period TF is equally divided into a plurality of sub-periods, e.g., four sub-periods as shown in FIG. 15. In each sub-period, a plurality of scanning electrodes, e.g., four scanning electrodes in this illustrative example, are simultaneously selected so that the orthogonality is established within one frame period TF. (T. N. Ruckmongathan et al., Japan Display '92, Digest, p. 65; Japanese Laid-Open Publication No. 5-46127; etc.)

(3) A method (hereinbelow, referred to as a driving method 3), where, as shown in FIG. 16, the scanning electrodes are grouped into a plurality of blocks (framed portions in the figure) each composed of scanning electrodes in the quantity smaller than the total number of scanning electrodes. Each block is divided into a plurality of groups each composed of scanning electrodes in the quantity smaller than the number of scanning electrodes in each block. A selection pulse sequence in accordance with an orthogonal function is supplied to the scanning electrodes in each block (indicated by L) group by group sequentially for a divided sub-period T of one frame period TF which is a period required to display one screen. The pulse is applied every predetermined time during the divided sub-period T, while a voltage of a fixed level is applied during the period other than the selected sub-period. A voltage corresponding to the sum of products of the orthogonal function and display data is applied to the data electrodes. These operations are performed for all the blocks within one frame period TF by shifting the timing. (Japanese Laid-Open Publication No. 6-291848)

However, all the above three driving methods tend to cause troubles, such as shadowing (whitening) in a horizontal direction (column direction) of the panel due to the difference between the electrical capacitance at portions of a liquid crystal material in the ON state and that at portions thereof in the OFF state, and image doubling due to dulling of the selection pulse itself, lowering the display quality. These troubles will be described in detail with reference to FIGS. 17 and 18.

(i) FIG. 17 shows an upper-half portion of a liquid crystal panel having 640 pixels in a horizontal direction and 480 pixels in a vertical direction. A black block (shown by hatched lines) is displayed for a white background on the upper-half portion. The liquid crystal capacitances at the following positions shown in FIG. 17 can be obtained by respective expressions as follows.

Points A and C (liquid crystal capacitance of ON pixels):

$$C_{ON}=\epsilon_{ON}\times\epsilon_0\times(S/d)$$

Point B (liquid crystal capacitance of OFF pixels):

$$C_{OFF}=\epsilon_{OFF}\times\epsilon_0\times(S/d)$$

Row $R_1$ crossing black block:

$$C_{R1}=C_{OFF}\times W+C_{ON}\times(W-w)$$

Row $R_2$ running only white background:

$$C_{R2}=C_{ON}\times W$$

where $\epsilon_0$ denotes the dielectric constant in vacuum; S denotes the area of one pixel; d denotes the cell thickness; $\epsilon_{ON}$ denotes the dielectric constant of an ON pixel; $\epsilon_{OFF}$ denotes the dielectric constant of an OFF pixel; w denotes the length (number of dots) in the horizontal direction of the black block; W denotes the length (number of dots) in the horizontal direction of the panel; R denotes the electrode resistance; and $\tau_{Ri}$ denotes the time constant of row $R_i$ (i=1, 2).

The difference between the time constant of row $R_1$ and that of row $R_2$ is represented by:

$$\begin{aligned}\tau_{R2} - \tau_{R1} &= C_{R2} \times R - C_{R1} \times R \\ &= (C_{R2} - C_{R1}) \times R \\ &= (C_{ON} - C_{OFF}) \times w \times R \\ &= (\epsilon_{ON} - \epsilon_{OFF}) \times \epsilon_0 \times (S/d) \times w \times R\end{aligned}$$

Since $\epsilon_{OFF} < \epsilon_{ON}$, $\tau_{R2} - \tau_{R1} > 0$.

Accordingly, as the time constant of row $R_2$ is greater than that of row $R_1$, the waveform of the selection pulse applied to row $R_2$ is more dulled than that applied to row $R_1$ as shown in FIGS. 18A and 18B, where solid lines represent the actual waveforms while the dash-dot lines represent ideal waveforms. As a result, the brightness at point A on a side of the black block is relatively higher than that at point C. This forms a band on the sides of the black block which appears brighter than the other portions of the screen, thus generating the shadowing (whitening).

(ii) Image Doubling

If the waveform at the tail of a selection pulse is dulled as shown in FIG. 18B, a portion which is not included in the current selected sub-period is also applied with the pulse. This results in the image doubling where a same image is vaguely displayed at a position shifted by the number of selected scanning electrodes.

SUMMARY OF THE INVENTION

According to one aspect of the present invention, a driving method of a liquid crystal display device of a matrix type including a plurality of scanning electrodes and a plurality of data electrodes is provided. Certain scanning electrodes are simultaneously selected and driven. In this driving method, a correction voltage is added to a scanning signal to be supplied to the certain scanning electrodes.

In one embodiment of the invention, the correction voltage has at least one pulse and a voltage obtained by adjusting a pulse width of the at least one pulse in accordance with the number of pixels on each scanning electrode which are to be in an ON or OFF state is used as the correction voltage to be superimposed on the scanning signal.

In another embodiment of the invention, the correction voltage has at least one pulse and a voltage obtained by adjusting a pulse amplitude of the at least one pulse in accordance with the number of pixels on each scanning electrode which are to be in an ON or OFF state is used as the correction voltage to be superimposed on the scanning signal.

In still another embodiment of the invention, the correction voltage has at least one pulse and a voltage obtained by adjusting a pulse width and a pulse amplitude of the at least one pulse in accordance with the number of pixels on each scanning electrode which are to be in an ON or OFF state is used as the correction voltage to be superimposed on the scanning signal.

In still another embodiment of the invention, the scanning signal is in a non-selection voltage level before the scanning signal rises, and the scanning signal is in the non-selection voltage level after the scanning signal falls.

In still another embodiment of the invention, a voltage signal for sharpening the rising of the actual pulse is further added to the scanning signal.

According to another aspect of the present invention, a liquid crystal display device of a matrix type including a plurality of scanning electrodes and a plurality of data electrodes is provided. The device includes: a detection section for detecting a liquid crystal capacitance of pixels corresponding to scanning electrodes which are to be in an ON or OFF state; a section for obtaining a correction signal for adjusting at least one of a pulse width and a pulse amplitude based on a detection result from the detection section; and a section for adding a correction voltage obtained based on the correction signal to each scanning signal and supplying the resultant signal to each scanning electrode.

Alternatively, a liquid crystal display device of a matrix type including a plurality of scanning electrodes and a plurality of data electrodes is provided. The device includes: a detection section for detecting the number of pixels corresponding to scanning electrodes which are to be in an ON or OFF state; a section for obtaining a correction signal for adjusting at least one of a pulse width and a pulse amplitude based on a detection result from the detection section; and a section for adding a correction voltage obtained based on the correction signal to each scanning signal and supplying the resultant signal to each scanning electrode.

In one embodiment of the invention, the scanning signal is in a non-selection voltage level before the scanning signal rises, and the scanning signal is in the non-selection voltage level after the scanning signal falls.

Thus, according to the present invention, the liquid crystal capacitance of pixels (or the number of pixels) on each scanning electrode which are to be in the ON or OFF state is detected, and a correction voltage value corresponding to the detected value is superimposed on a scanning signal. This reduces the difference in the effective voltage value applied to liquid crystal. The correction voltage value can be obtained by adjusting the pulse width (while keeping the pulse amplitude unchanged) and/or the pulse amplitude (while keeping the pulse width unchanged), or by adjusting both the pulse width and the pulse amplitude. The point is that a correction voltage value capable of providing an optimal display status determined depending on the liquid crystal display device should be used.

As a result of the reduced difference in the effective voltage applied to liquid crystal, the dulling of the waveform is prevented from influencing outside the selected period. Thus, a good display quality free from the shadowing or the image doubling due to the waveform dulling can be obtained.

The elimination of the image doubling with no influence of a segment voltage is ensured by putting a predetermined period starting from the rising of the selection pulse and a predetermined period ending at the falling thereof in a non-selection voltage level. This provides a higher display quality. In this case, preferably, a voltage for sharpening the rising of the actual pulse may be further superimposed on the scanning signal.

The liquid crystal capacitance of pixels (or the number of pixels) on each scanning line which are to be in the ON state or the OFF state is detected as described above. When the pixels which are to be in the ON state are used, the liquid crystal capacitance of pixels (or the number of pixels) which are to be in the ON state may be directly detected, or the liquid crystal capacitance of pixels (or the number of pixels) which are to be in the OFF state may be subtracted from the total liquid crystal capacitance of pixels (or the total number of pixels. In reverse, When the pixels which are to be in the OFF state are used, the liquid crystal capacitance of pixels (or the number of pixels) which are to be in the OFF state may be directly detected, or the liquid crystal capacitance of pixels (or the number of pixels) which are to be in the ON state may be subtracted from the total liquid crystal capacitance of pixels (or the total number of pixels).

Thus, the invention described herein makes possible the advantages of (1) providing a liquid crystal display device with good display quality free from shadowing or image doubling due to waveform dulling, and (2) providing a driving method of such a liquid crystal display device.

These and other advantages of the present invention will become apparent to those skilled in the art upon reading and understanding the following detailed description with reference to the accompanying figures.

BRIEF DESCRIPTION OF THE DRAWINGS

FIG. 14 shows an exemplary driving function in the AA method.

FIG. 15 shows an exemplary driving function in the SAT method.

DESCRIPTION OF THE PREFERRED EMBODIMENTS

The present invention will be described by way of examples with reference to the accompanying drawings.

EXAMPLE 1

In Example 1, a configuration and a method for correcting a scanning signal by use of a correction signal having a fixed amplitude and a varying pulse width will be described.

Figure 1:
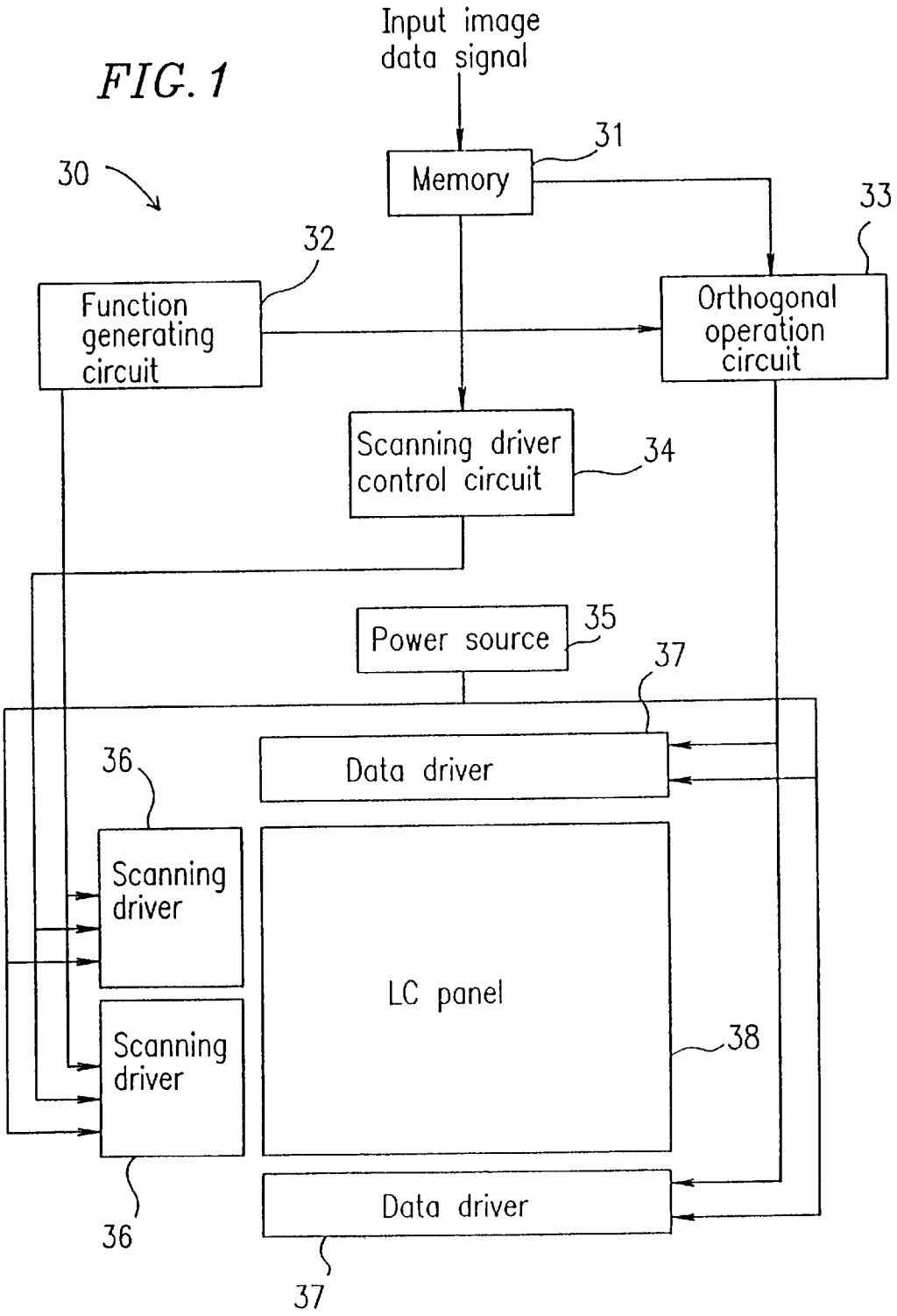
FIG. 1 is a block diagram of a circuit configuration illustrating a liquid crystal display device (Examples 1 to 3) and a driving method thereof according to the present invention.

FIG. 1 is a block diagram illustrating the entire configuration of a liquid crystal display device 30 of Example 1 according to the present invention.

The liquid crystal display device 30 includes a memory 31 for temporarily storing an input image data signal supplied from outside, a function generating circuit 32 for generating an orthogonal function, an orthogonal operation circuit 33 for operating the orthogonal function supplied from the function generating circuit 32 and the input image data signal read from the memory 31, and a scanning driver control circuit 34 for performing processings such as correction, pulse cutting, and the like on the signal read from the memory 31 to control a scanning voltage. The liquid crystal display device 30 also includes a liquid crystal panel 38 for displaying an image, scanning drivers 36 each for applying the scanning voltage to the liquid crystal panel 38 based on an output signal of the function generating circuit 32 and output signals of the scanning driver control circuit 34 (a correction signal and a pulse cutting signal), and data drivers 37 each for applying a data voltage to the liquid crystal panel 38 based on an output signal of the orthogonal operation circuit 33. A power source 35 supplies respective voltage levels to the scanning drivers 36 and the data drivers 37.

Figure 2:
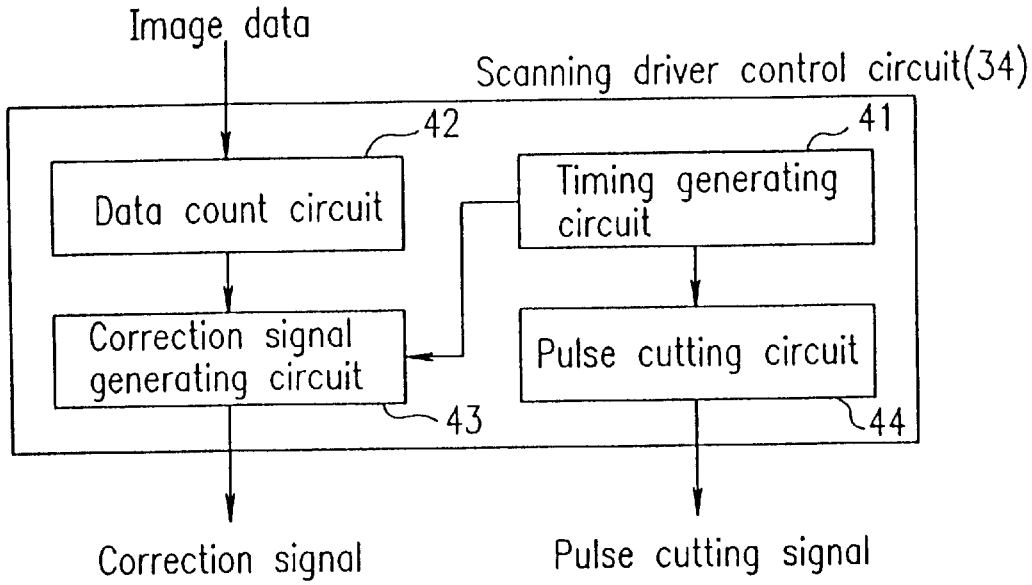
FIG. 2 is a block diagram of a circuit configuration of a scanning driver control circuit of the liquid crystal display device of FIG. 1.

FIG. 2 is a block diagram illustrating the configuration of the scanning driver control circuit 34. The scanning driver control circuit 34 includes a timing generating circuit 41 for generating a correction timing and the timings of the rising and falling of a selection pulse, a data count circuit 42 for counting the number of ON states included in the image data signal read from the memory 31 which are to put corresponding pixels in the ON state, a correction signal generating circuit 43 for generating a correction signal having a fixed amplitude and a pulse width varying depending on the count results from the data count circuit 42, and a pulse cutting signal generating circuit 44 for generating a pulse cutting signal.

The pulse cutting signal generating circuit 44 divides a timing signal received from the timing generating circuit 41 to generate a unit pulse cutting time signal. The pulse cutting signal generating circuit 44 also receives a signal instructing to multiply the unit pulse cutting time signal by predetermined times, e.g., a pulse cutting time selection signal (not shown). The unit pulse cutting time signal is thus multiplied by the predetermined times based on the pulse cutting time selection signal, to generate the pulse cutting signal.

Figure 3:
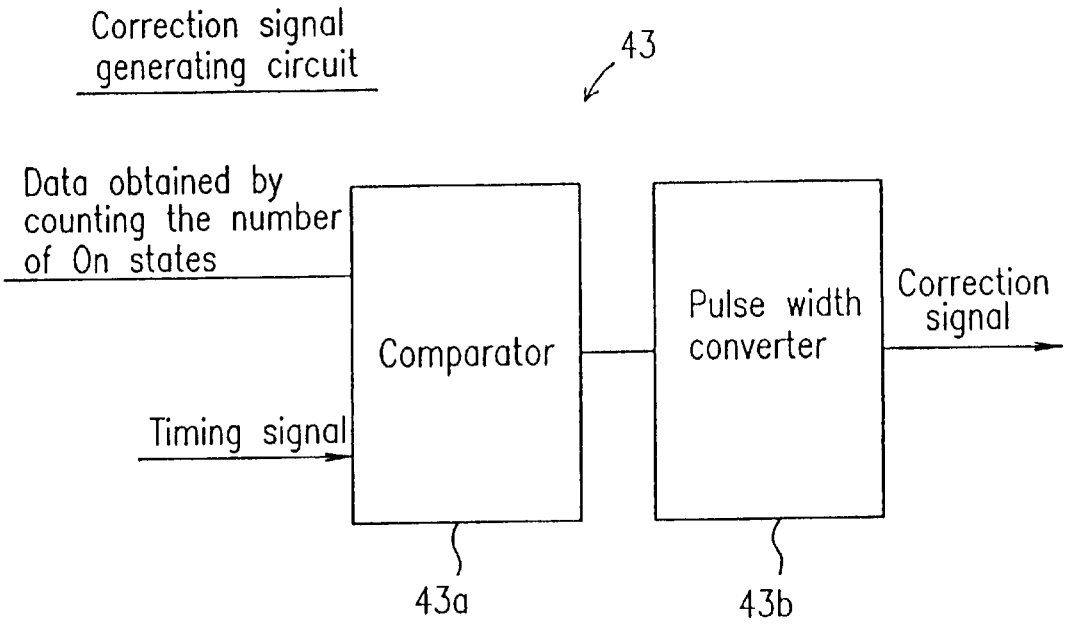
FIG. 3 is a block diagram of a circuit configuration of a correction signal generating circuit of the scanning driver control circuit of FIG. 2 in Example 1.

FIG. 3 is a block diagram illustrating the correction signal generating circuit 43. The correction signal generating circuit 43 includes a comparator 43*a* which receives data obtained by counting the number of ON states supplied from the data count circuit 42 and a correction timing signal supplied from the timing generating circuit 41 and a pulse width converter 43*b* for determining a pulse width correction signal based on an output from the comparator 43*a*.

The comparator 43*a* classifies the data representing the number of ON states in response to the timing signal. When the data representing the number of ON states is M-bit data, for example, the comparator 43*a* determines to which class the value of the upper N bits of the M-bit data belongs, and outputs the results to the pulse width converter 43*b*.

In other words, the correction signal generating circuit 43 generates the correction signal for correcting the pulse width (while keeping the amplitude unchanged) for obtaining a corrected voltage value corresponding to data relating to the number of pixels which are to be turned to the ON state lined along each scanning electrode at a timing corresponding to the correction timing signal.

Figure 4A:
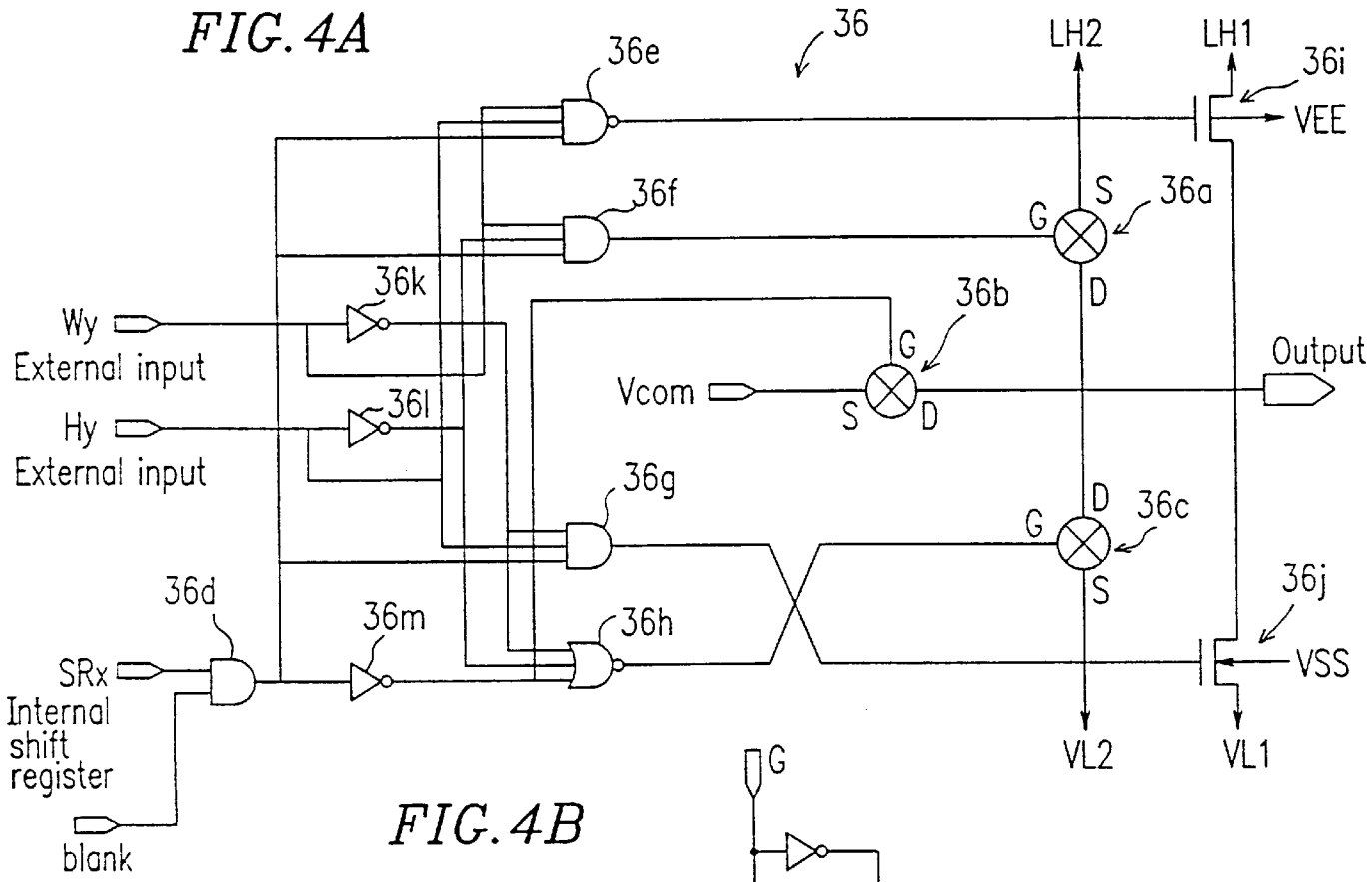
FIG. 4A is a circuit diagram of a scanning driver of the liquid crystal display device of Example 1.
Figure 4B:
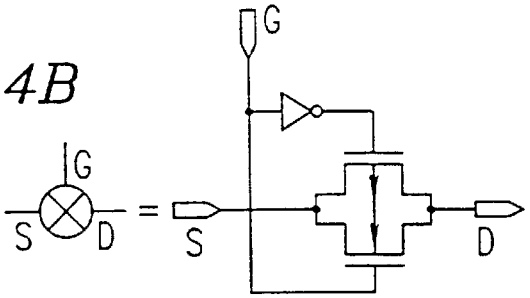
FIG. 4B is a detailed circuit diagram of a transistor in FIG. 4A.

FIG. 4A is a circuit diagram of each scanning driver 36, which includes transistors 36*a*, 36*b*, 36*c*, 36*i*, and 36*j*, gate circuits 36*d*, 36*e*, 36*f*, 36*g*, and 36*h*, and inverters 36*k*, 36*l*, and 36*m*. FIG. 4B shows a circuit configuration of the transistors 36*a*, 36*b*, and 36*c* in more detail. An input Wy to the scanning driver 36 is the function signal supplied from the function generating circuit 32, and an input Hy is the pulse width correction signal supplied from the correction signal generating circuit 43. An input blank is a signal for reducing the width of the selection pulse itself, i.e., setting the rising and falling of the pulse at a non-selection voltage level as will be described later. An input $SR_x$ is an output signal from an internal shift register (not shown). The signal $SR_x$ denotes a signal which decides the selected period of the scanning signal corresponding to X row. In the case of using the driving function shown in FIG. 16, the signal $SR_1$ is at a high level during 1H and 3H and otherwise at a low level, the signal $SR_2$ is at a high level during 1H and 3H and otherwise at a low level, the signal $SR_3$ is at a high level during 2H and 4H and otherwise at a low level, the signal $SR_4$ is at a high level during 2H and 4H and otherwise at a low level, and the like. $V_{ss}$ denotes a ground level signal. $V_{com}$ denotes a signal of the non-selection voltage level, e.g., a signal of about 20 volts. $V_{EE}$ denotes a voltage signal for driving liquid crystal, e.g., a signal of about 40 volts. $VH_1$ denotes a signal of a positive correction voltage level, $VH_2$ denotes a signal of a positive selection level, $VL_1$ denotes a signal of a negative correction voltage level, and $VL_2$ denotes a signal of a negative selection level. The non-selection voltage level means the level of the scanning voltage in the non-selected period.

Table 1 below is a truth table showing the operation of the scanning driver 36.

TABLE 1

| Blank | Function input Wy | Correction signal input Hy | Internol shift register input SRx | Driver output |
|---|---|---|---|---|
| H | L | L | L | Vcom |
| H | L | H | H | VL1 |
| H | L | H | L | Vcom |
| H | L | L | H | VL2 |
| H | H | L | L | Vcom |
| H | H | L | H | VH2 |
| H | H | H | L | Vcom |

TABLE 1-continued

| Blank | Function input Wy | Correction signal input Hy | Internol shift register input SRx | Driver output |
|---|---|---|---|---|
| H | H | H | H | VH1 |
| L | * | * | * | Vcom |

VSS ≦ VL1 ≦ VL2 ≦ Vcom ≦ VH2 ≦ VH1 ≦ VEE
*Don't care

The liquid crystal display device of this example with the above configuration is operated in the following manner. The input image data signal supplied from an external signal source is written in the memory 31 in the row direction and read by an amount corresponding to the number of selected scanning electrodes in the column direction. Then, the orthogonal operation circuit 33 performs orthogonal operation of the image data signal read from the memory 31 and the orthogonal function generated by the function generating circuit 32. An output voltage of each data driver 37 is determined based on the results of the orthogonal operation.

According to the present invention, as one of the means for detecting the liquid crystal capacitance, the data count circuit 42 of the scanning driver control circuit 34 reads the image data signal from the memory 31 and counts the number of pixels where image data is to be supplied in the row direction. The relationship between the number $\chi$ of pixels which are to be in the ON state and the liquid crystal capacitance C of the length in the horizontal direction of the panel is represented by:

$$C=C_{OFF}\times(W-\chi)+C_{ON}\chi$$

wherein $C_{ON}$ denotes the liquid crystal capacitance of ON pixels and $C_{OFF}$ denotes the liquid crystal capacitance of OFF pixels.

Only a voltage level determined based on the orthogonal function is used as the output of the scanning driver 36. In addition, according to the present invention, the correction signal generating circuit 43 of the scanning driver control circuit 34 outputs the pulse width correction signal based on the counting results from the data count circuit 42. The scanning driver 36 adds a desired amount of correction, i.e., a desired number of correction pulses as shown in FIGS. 5A and 5B, corresponding to the correction signal to the voltage level, to obtain an output voltage value.

The scanning driver 36 adds the correction pulses to the scanning signal to be applied to the scanning electrode selected at a certain time. The scanning driver 36 is informed of which scanning electrode is selected at the certain time by the internal shift register signal $SR_x$. When the liquid crystal display device according to the present invention employs an L line simultaneous selection driving method, L scanning lines are simultaneously selected at a certain time. In this case, a correction voltage composed of correction pulses is generated based on image data corresponding to each of the selected lines.

In the scanning driver according to the present invention, the cutting width of the selection pulse can be selected by stages. Based on the signal blank which is the control signal output from the pulse cutting signal generating circuit 44, the scanning driver 36 outputs a signal where a predetermined period $T_1$ starting from the rising of the selection pulse and a predetermined period $T_2$ ending at the falling thereof are set at the non-selection voltage level.

Figure 5A:
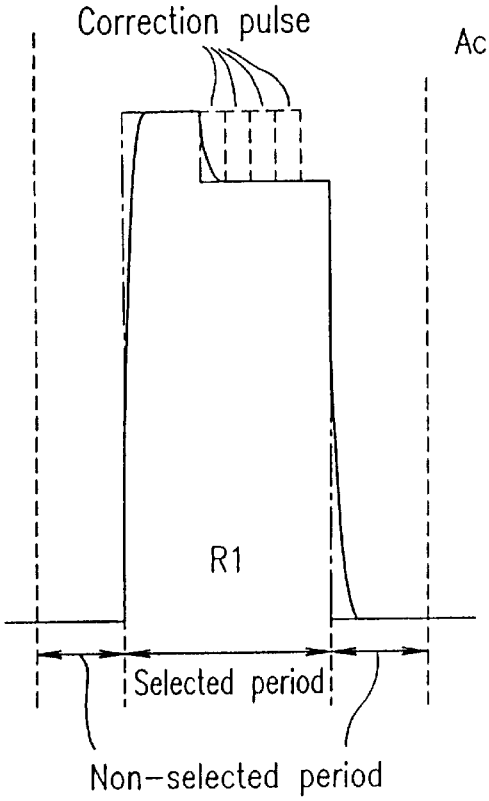
FIGS. 5A and 5B show actual waveforms of a selection pulse used in a driving method of the liquid crystal display device of Example 1.
Figure 5B:
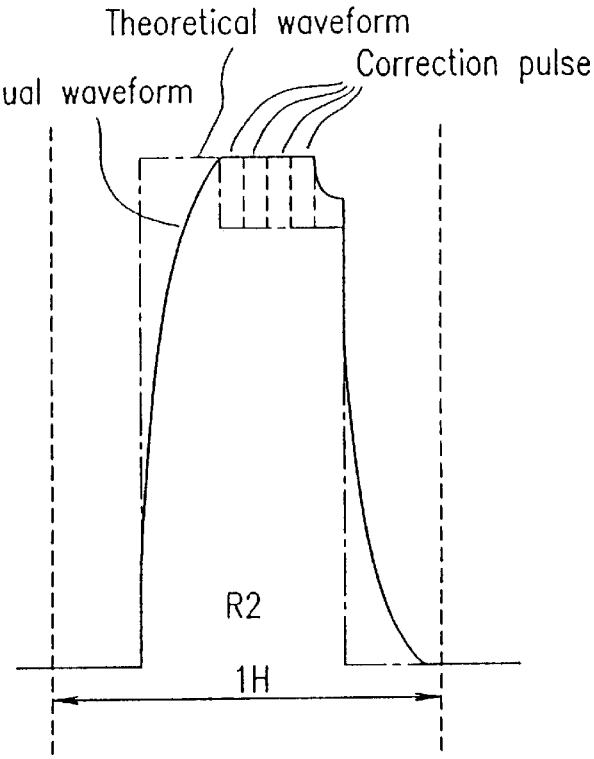
Figures 16, 17:
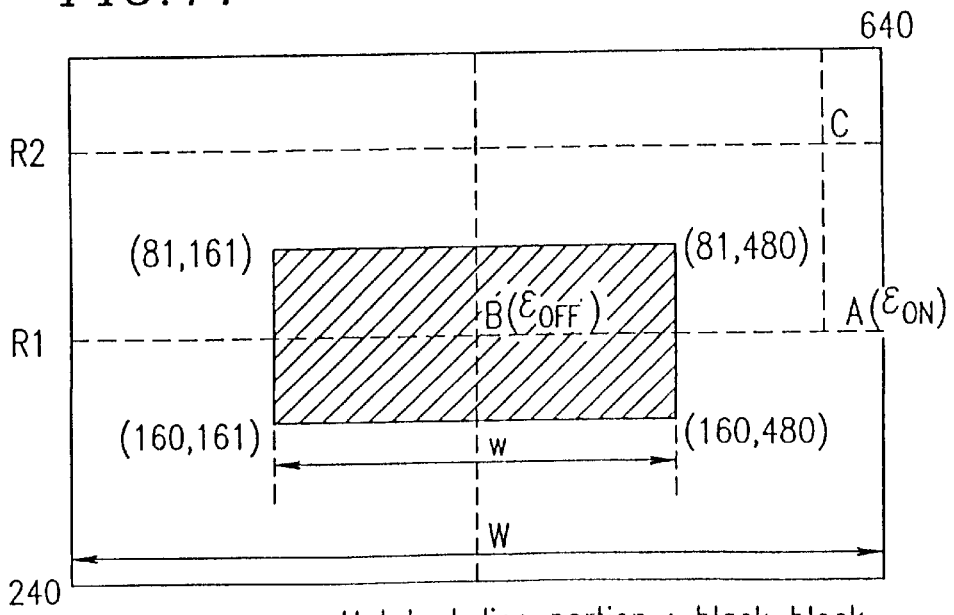
FIG. 16 shows an exemplary driving function in the inner-block dispersion driving method (driving method 3).
FIG. 17 shows an exemplary display of a liquid crystal panel for describing a cause for lowered display quality in the conventional driving method.
Figure 18A:
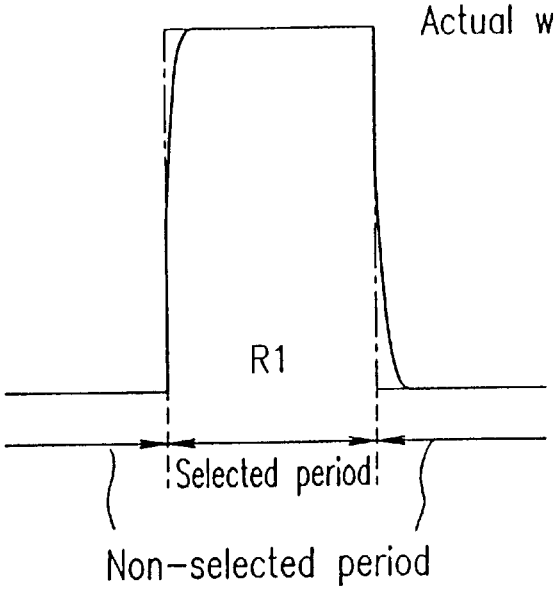
FIGS. 18A and 18B show waveforms of a selection pulse for describing a cause for lowered display quality in the conventional driving method.
Figure 18B:
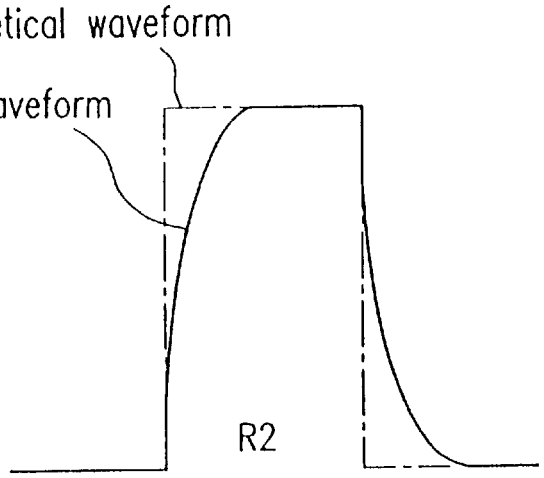

FIGS. 5A and 5B show actual selection pulses with an addition of correction voltages used when the display shown in FIG. 17 is performed. FIG. 5A is a waveform of the pulse applied to row R1 in FIG. 17, where no correction pulse is added. FIG. 5B is a waveform of the pulse applied to row R2 in FIG. 17, where four correction pulses are added. As will be understood from FIGS. 5A and 5B, the difference in the effective value of the pulse between rows R1 and R2 is small compared with the case where no correction is performed (FIGS. 18A and 18B). In this illustrative example, the correction pulse widths have been previously determined so that the correction is effected in four levels. The number of correction pulses may be more than or less than four. The point is that the number of correction pulses may be determined so as to obtain a good display status.

Figure 19:
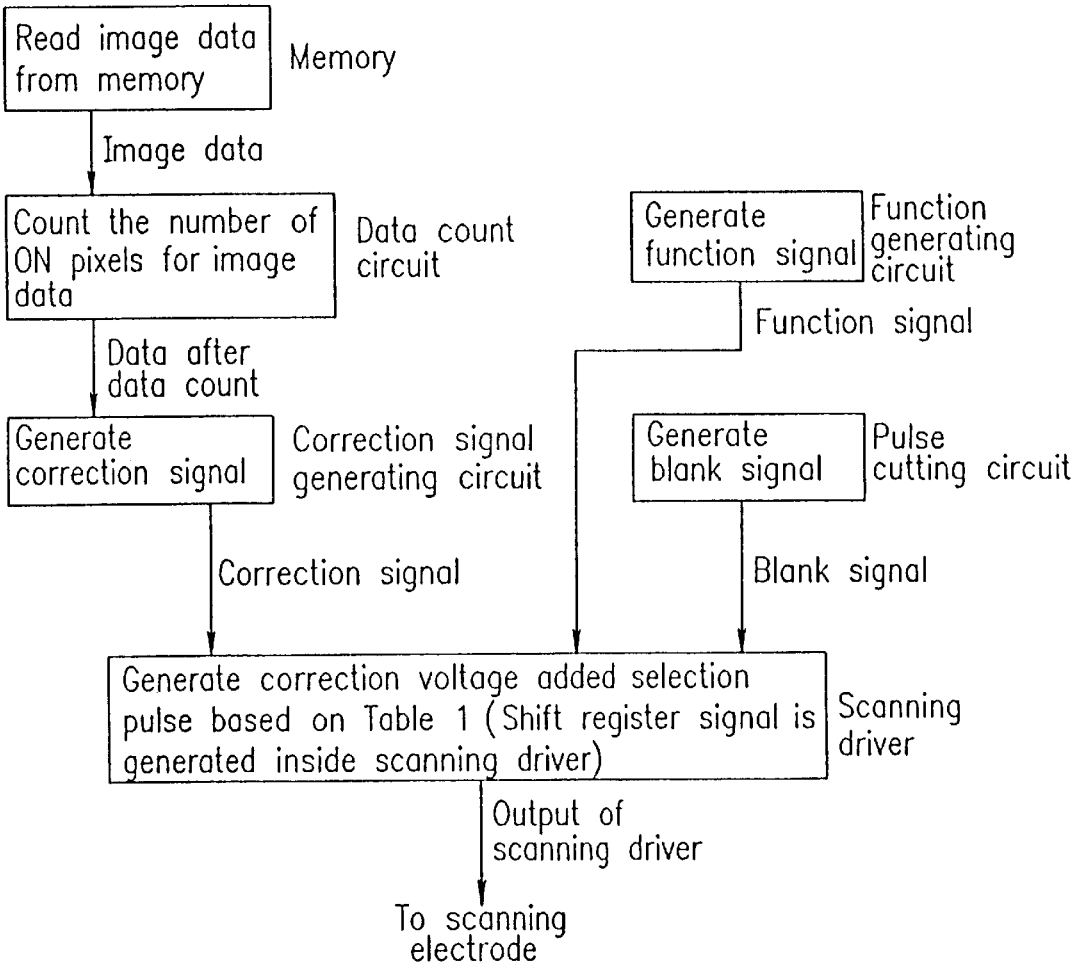
FIG. 19 is an exemplified flow chart of signals according to the present invention.

FIG. 19 is an exemplified flow chart showing the flow of signals in this example. The voltage to be applied to the scanning electrodes may be generated as shown in FIG. 19. This flow of voltage generation may also be applied to Examples 2 and 3 to be described later.

Hereinbelow, an example of results of a display test performed by the aforementioned driving method 3 will be described.

Figure 6A:
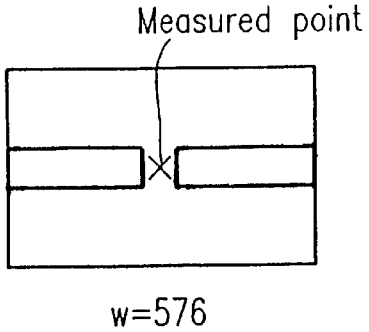
FIGS. 6A to 6C show displays used for optical measurements of the liquid crystal display device of Example 1.
Figure 6B:
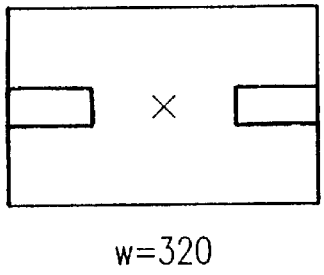
Figure 6C:
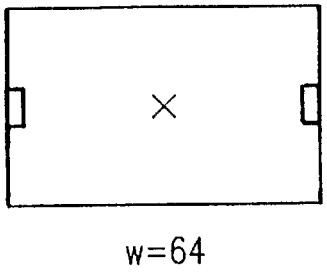

A VGA liquid crystal panel with the number of scanning lines L in one block of 120, the number of simultaneously selected scanning lines of 4, the response rate of 300 ms, and the number of pixels of 640×480×3 (RGB) was driven at a frame frequency of 150 Hz. The panel screen was divided into upper-half and lower-half portions for separate driving. A horizontal black bar was displayed on the upper-half portion of the screen. The resultant brightness and the occurrence of shadowing obtained for the panel according to the present invention were compared with those for a panel where the present invention was not applied. The test was performed for three cases where the total length (the number of dots) of black bars was 576, 320, and 64 as shown in FIGS. 6A, 6B, and 6C, respectively.

Figures 7A, 7B:
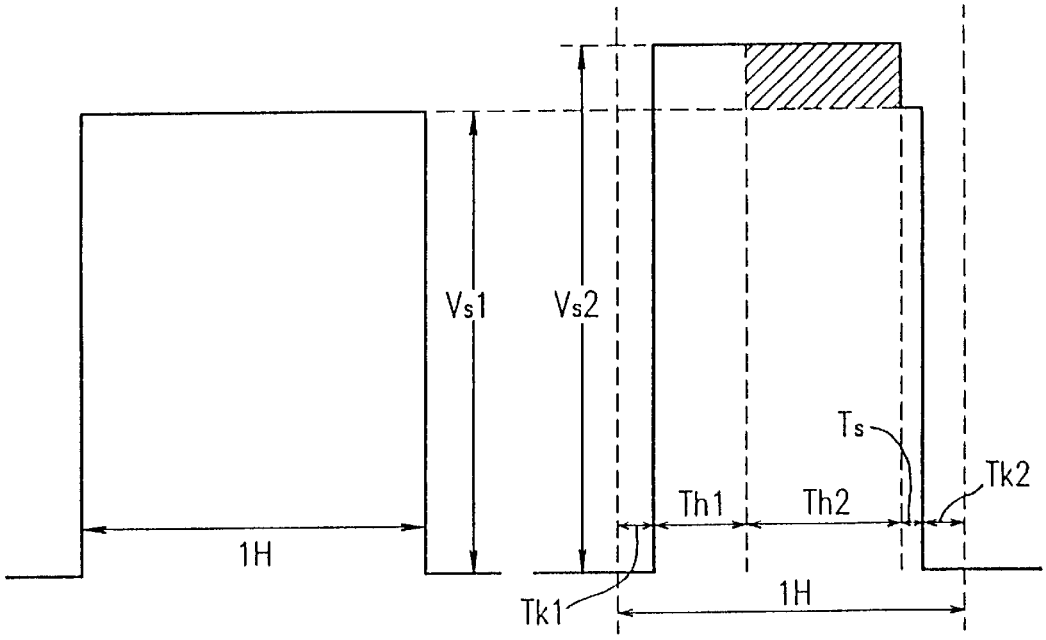
FIGS. 7A and 7B schematically show selection pulses used in a conventional driving method and the driving method of the liquid crystal display device of Example 1, respectively.

FIGS. 7A and 7B show the selection pulses used in the conventional driving method and in this example, respectively. The selection pulse used in the conventional driving method has an amplitude $Vs_1$, while the selection pulse used in this example has an amplitude $Vs_2$. In the driving method according to the present invention, there are provided a head pulse cutting period $Tk_1$ and an end pulse cutting period $Tk_2$ where the scanning signal is put in the non-selection voltage level.

The selection pulse rises in synchronization with the rising of the signal blank and falls in synchronization with the falling of the signal blank. In other words, the timing at which the period $Tk_1$ terminates and the timing at which the period $Tk_2$ starts are determined by the signal blank. The signal blank is determined by an external switch (not shown) or the like. The contrast lowers when the period $Tk_1$ and the period $Tk_2$ are excessively long. The prevention of image doubling fails when the period $Tk_1$ and the period $Tk_2$ are excessively short.

In the driving method according to the present invention, also, two correction periods $Th_1$ and $Th_2$ are provided. In the correction period $Th_1$, a fixed correction voltage ($Vs_2-Vs_1$) is added to the selection pulse to sharpen the rising of the actual pulse. In the correction period $Th_2$, a correction corresponding to the difference in the liquid crystal capacitance on the scanning electrode is added. A waveform adjusting period Ts is also provided so that the corrected voltage level can once fall to the selection voltage level before shifting to the non-selection voltage level whatever correction amount has been added, so as to obtain uniform waveforms at the falling of all the selection pulses. The corrected voltage level means the scanning voltage output from the scanning driver 36 during the period when the correction voltage is applied in the selected period, while the selection voltage level means the scanning voltage output from the scanning driver 36 during the period when no correction voltage is applied in the selected period. The waveform adjusting period Ts is preferably provided, but may be omitted if no problem arises when omitted.

The above waveform adjustment technique is adopted to the waveforms of the selection pulse shown in FIGS. 5A and 5B. This is also adopted to waveforms shown in FIGS. 11A and 11B in Example 2 and in FIGS. 13A and 13B in Example 3 to be described later.

In this example, the above voltages and times were set as follows: $Vs_1$=29.1 V, $VS_2$=1.05×$Vs_1$=30.6 V, $Tk_1$=2.2 μs, $Tk_2$=3.3 μs, $Th_1$=6.6 μs, $Th_2$=8.8 μs, and Ts=1.1 μs. These values are not restrictive but merely illustrative for use in this example.

Tables 2 to 4 below show the brightnesses measured when correction voltages with an optimal correction width and a fixed correction width were applied for the respective black bars shown in FIGS. 6A to 6C, respectively.

TABLE 2

| | Fixed correction width | Optional correction width |
|---|---|---|
| Length of black block = 576 (dot) | Correction width = 6.6 (μs) 64.8 (cd/m$^2$) | * * * * * * |

TABLE 3

| | Fixed correction width | Optional correction width |
|---|---|---|
| Length of black block = 320 (dot) | Correction width = 6.6 (μs) 56.3 (cd/m$^2$) | Correction width = 11.0 (μs) 65.6 (cd/m$^2$) |

TABLE 4

| | Fixed correction width | Optional correction width |
|---|---|---|
| Length of black block = 64 (dot) | Correction width = 6.6 (μs) 50.1 (cd/m$^2$) | Correction width = 14.3 (μs) 65.5 (cd/m$^2$) |

Figure 8:
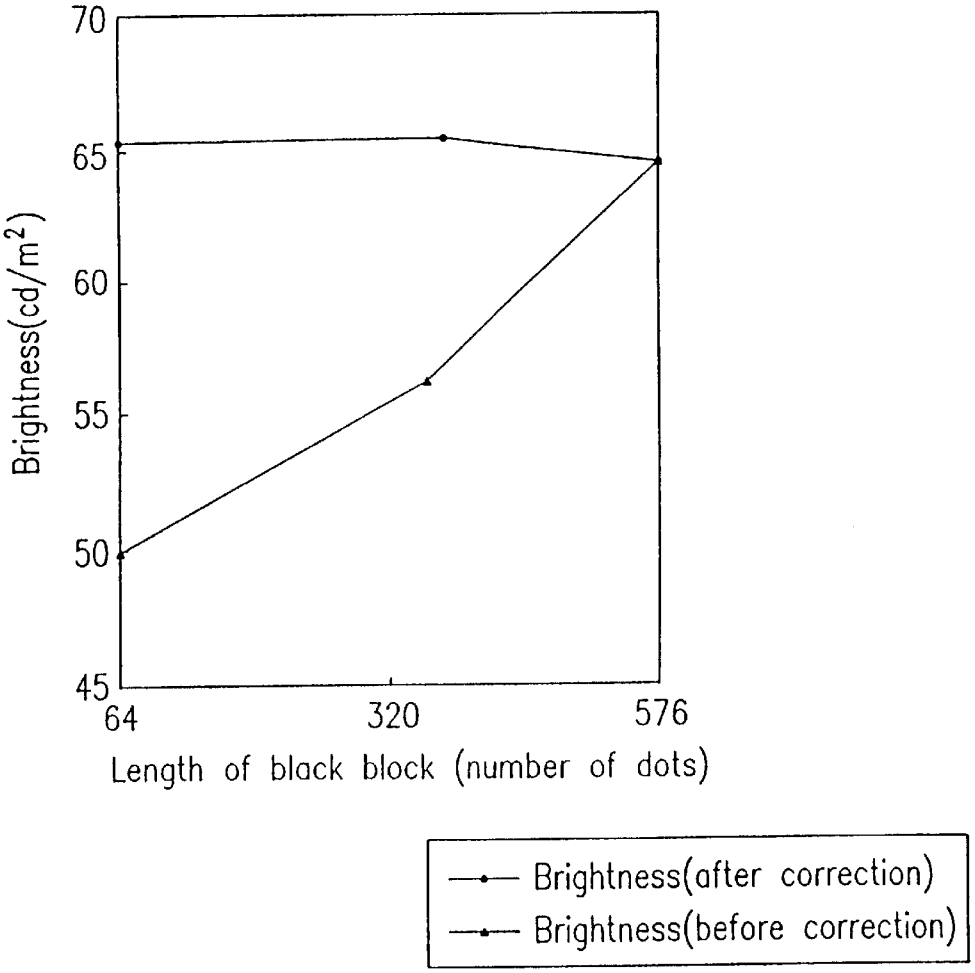
FIG. 8 shows results of the optical measurements of the liquid crystal display device of Example 1, showing effects of the correction.

As shown in Tables 2 to 4 and FIG. 8, the brightness was measured for each of the three cases where the different lengths of black bars as shown in FIGS. 6A to 6C were displayed. In each case, a correction voltage with a correction width optimal to each black bar and a correction voltage with a fixed correction width (6.6 μs) were applied. More specifically, Table 2 shows the measurement of the brightness obtained when a correction voltage with a fixed width (6.6 μs) is applied in the case where the total length of the black bars is 576 dots. Table 3 shows the measurements of the brightnesses obtained when a correction voltage with a fixed width (6.6 μs) and a correction voltage with an optimal correction width are applied in the case where the total length of the black bars is 320 dots. Table 4 shows the measurement of the brightnesses obtained when a correction voltage with a fixed width (6.6 $\mu$s) and a correction voltage with an optimal correction width are applied in the case where the total length of the black bars is 64 dots.

As is observed from Tables 2 to 4 and FIG. 8, the difference of the brightness at the portion of the white background located on the side of the black bars from that at the other portion of the white background is eliminated by adding an optimal correction amount to the selection pulse.

Thus, when the display shown in FIG. 17 is effected in the liquid crystal display device of this example, the difference in the brightness between points A and C is eliminated. This prevents the occurrence of horizontal shadowing and uniform white background is realized. The occurrence of image doubling is also prevented by cutting the width of the selection pulse.

EXAMPLE 2

In Example 2, a scanning signal is corrected using a correction signal where the amplitude varies while the pulse width is unchanged.

The liquid crystal display device of this example has substantially the same configuration as that of Example 1 shown in FIG. 1. The only exceptions are that a correction signal generating circuit 50 shown in FIG. 9 is used for the scanning driver control circuit 34 (FIG. 2) and that a scanning driver 51 having a circuit configuration shown in FIG. 10A is used.

Figure 9:
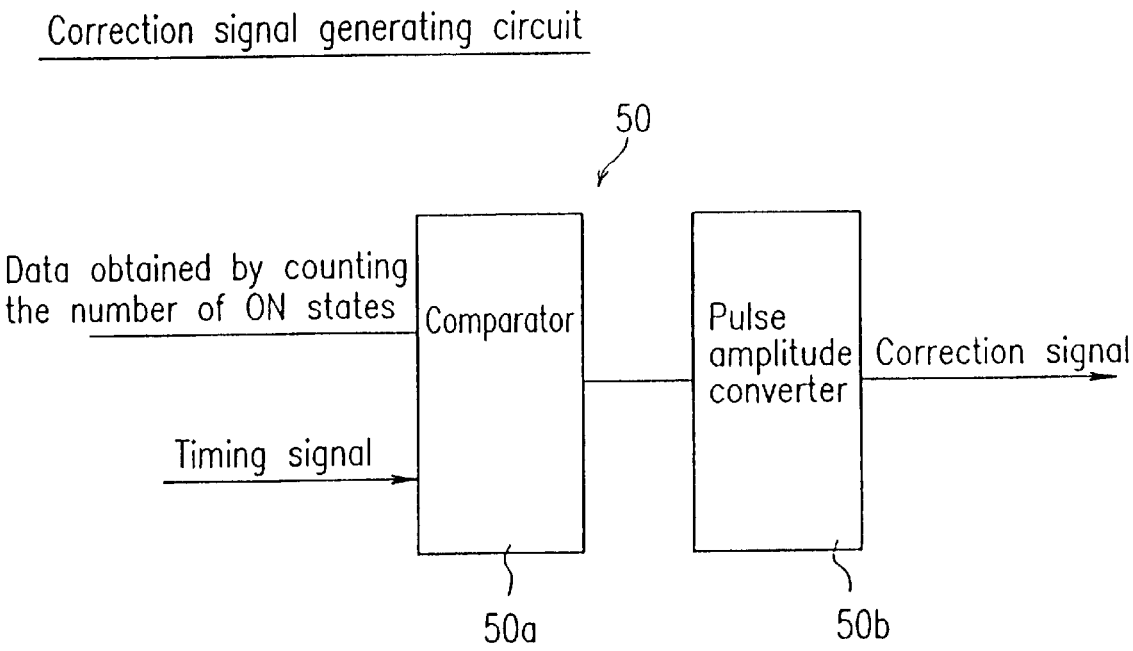
FIG. 9 is a block diagram of a circuit configuration of a correction signal generating circuit of the scanning driver control circuit of the liquid crystal display device of Example 2 according to the present invention.

The correction signal generating circuit 50 shown in FIG. 9 includes a comparator 50*a* which receives data obtained by counting the number of ON states supplied from the data count circuit 42 and a correction timing signal supplied from the timing generating circuit 41 and a pulse amplitude converter 50*b* for determining a pulse amplitude correction signal based on an output from the comparator 50*a* (the pulse width is unchanged).

The correction signal generating circuit 50 generates the correction signal for correcting the pulse amplitude (while keeping the pulse width unchanged) for obtaining a corrected voltage value corresponding to data relating to the number of pixels which are to be turned to the ON state lined along each scanning electrode at a timing corresponding to the correction timing signal.

Figures 10A, 10B:
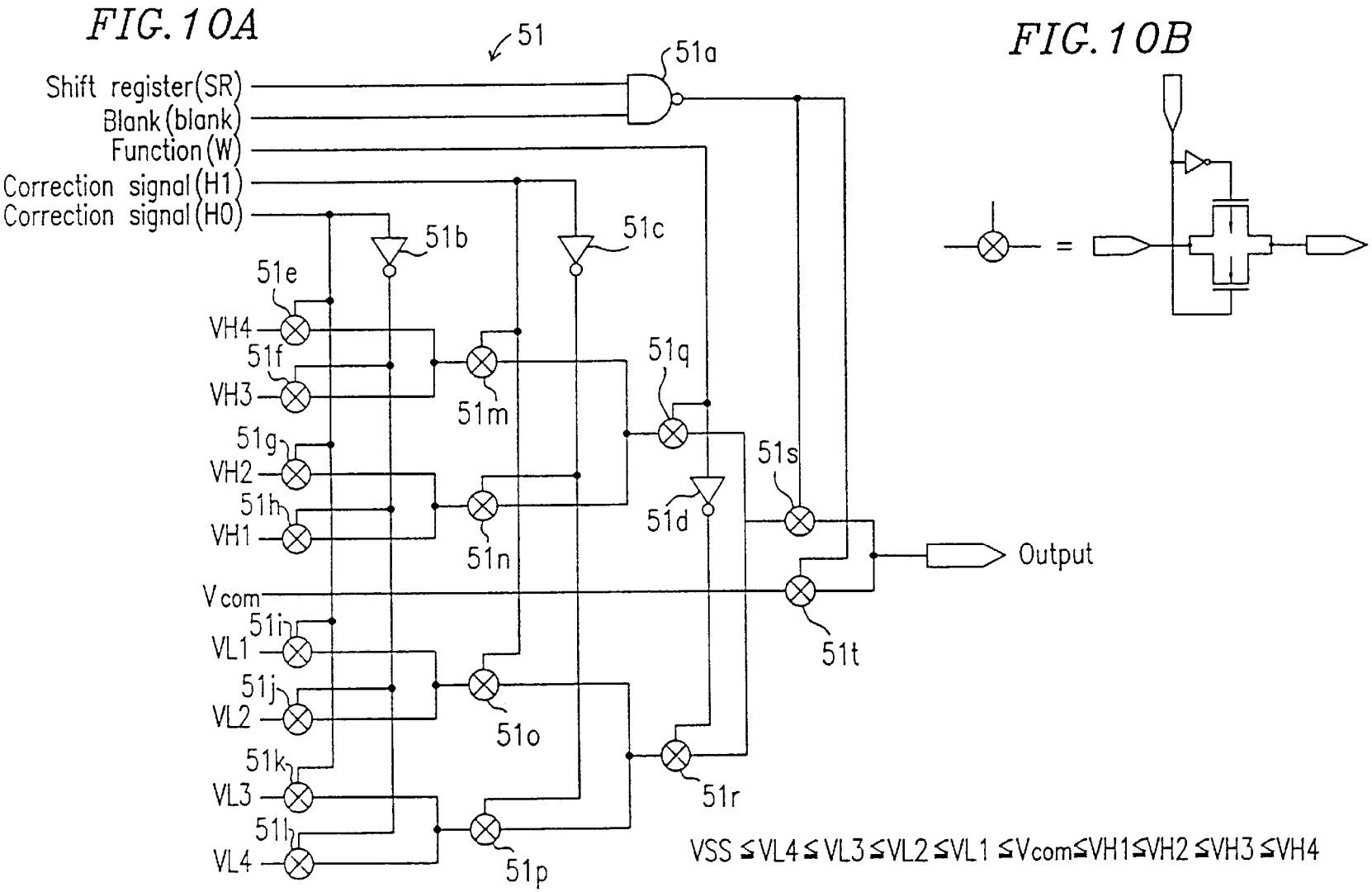
FIG. 10A is a circuit diagram of a scanning driver of the liquid crystal display device of Example 2.
FIG. 10B is a detailed circuit diagram of a transistor in FIG. 10A.

The scanning driver 51 in this example shown in FIG. 10A has a circuit configuration which is different from the scanning driver 36 in Example 1 so as to correspond to the configuration of the correction signal generating circuit 50. The scanning driver 51 includes one gate circuit 51*a*, three inverters 51*b*, 51*c*, and 51*d*, and 16 transistors 51*e* to 51*t*. FIG. 10B shows the circuit configuration of the transistors 51*e* to 51*t* in detail. The scanning driver 51 receives a function signal W supplied from the function generating circuit 32, a signal blank for reducing the width of the selection pulse itself, pulse amplitude correction signals $H_0$ and $H_1$, an output signal SR from a shift register, and the like. In this example, the pulse amplitude correction signal is divided into two signals $H_0$ and $H_1$ for binary representation in correspondence with a 4-value correction voltage level as shown in FIG. 10A. Voltages $VH_1$ to $VH_4$ and $VL_1$ to $VL_4$ supplied from the power source 35 have been adjusted to potentials having an addition of a correction voltage 1 shown in FIG. 11B.

Table 5 below is a truth table showing the operation of the scanning driver 51.

TABLE 5

| Blank | SR | W | H1 | H0 | Driver output |
|---|---|---|---|---|---|
| L | * | * | * | * | * |
| H | L | * | * | * | * |
| H | H | L | L | L | VL4 |
| H | H | L | L | H | VL5 |
| H | H | L | H | L | VL2 |
| H | H | L | H | H | VL1 |
| H | H | H | L | L | VH1 |
| H | H | H | L | H | VH2 |
| H | H | H | H | L | VH3 |
| H | H | H | H | H | VH4 |

*Don't care

VSS ≦ VL4 ≦ VL3 ≦ VL2 ≦ VL1 ≦ Vcom ≦ VH1 ≦ VH2 ≦ VH3 ≦ VH4

The liquid crystal display device of this example with the above configuration is operated in the following manner. The input image data signal supplied from an external signal source is written in the memory 31 and read by an amount corresponding to the number of selected scanning electrodes in the column direction. Then, the orthogonal operation circuit 33 performs orthogonal operation of the image data signal read from the memory 31 and the orthogonal function generated by the function generating circuit 32. An output voltage of each data driver 51 is determined based on the results of the orthogonal operation.

Conventionally, only a voltage level determined based on the orthogonal function is used as the output of the scanning driver 36. According to the present invention, as one of the means for detecting the liquid crystal capacitance, the data count circuit 42 of the scanning driver control circuit 34 reads the image data signal from the memory 31 and counts the number of pixels where image data is to be supplied in the row direction. The correction signal generating circuit 50 of the scanning driver control circuit 34 outputs the pulse amplitude correction signal based on the counting results from the data count circuit 42. The scanning driver 51 adds a desired amount of correction, i.e., a correction voltage 2 shown in FIG. 11B, corresponding to the correction signal to the voltage level, to obtain an output voltage value.

According to the present invention, the width of the selection pulse can be reduced by stages. As shown in FIG. 11B, based on the control signal output from the pulse cutting signal generating circuit 44, the scanning driver 51 outputs a signal where a predetermined period $Tk_1$ starting from the rising of the selection pulse and a predetermined period $Tk_2$ ending at the falling thereof are set at the non-selection voltage level. The scanning driver 51 outputs not only the correction voltage value based on the number of pixels which are to be in the ON state (the correction voltage 2 shown in FIG. 11B), but also a correction voltage for sharpening the rising of the actual pulse (a correction voltage 1 shown in FIG. 11B).

Figure 11A:
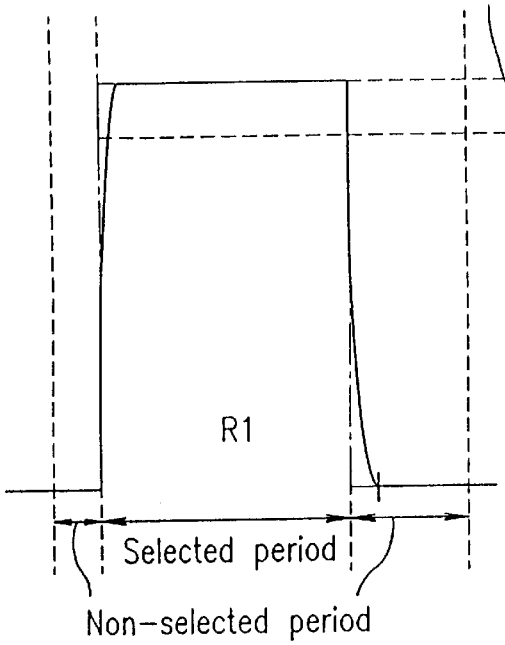
FIGS. 11A and 11B show actual waveforms of a selection pulse used in a driving method of the liquid crystal display device of Example 2.
Figure 11B:
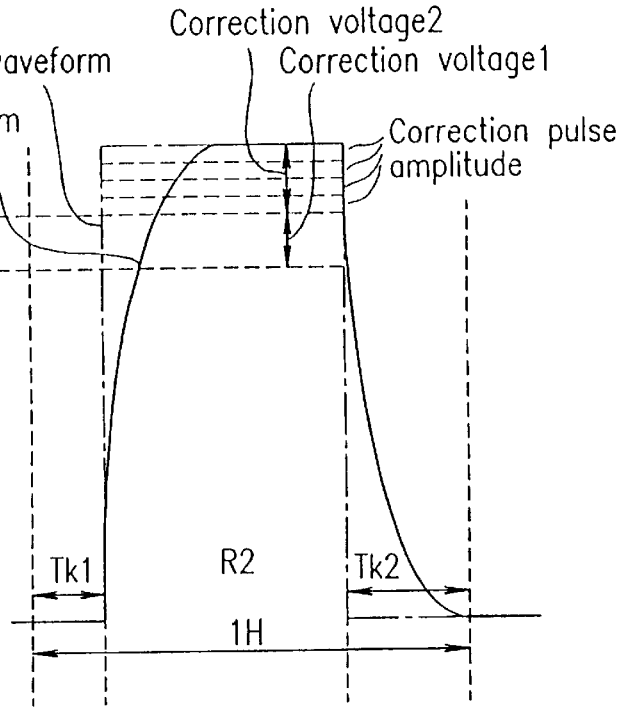

FIGS. 11A and 11B show waveforms of the actual selection pulses with an addition of a correction used when the display shown in FIG. 17 is effected. FIG. 11A is a waveform of the pulse applied to row R1 in FIG. 17, where no correction pulse amplitude is added. FIG. 11B is a waveform of the pulse applied to row R2 in FIG. 17, where four correction pulse amplitudes are added. As will be understood from FIGS. 11A and 11B, the difference in the effective value of the pulse between rows R1 and R2 is small compared with the case where no correction is performed (FIGS. 18A and 18B). In this illustrative example, the amplitude of each correction pulse for the correction voltage 2 has been previously determined so that the correction is effected at four levels. The number of correction pulses may be more than or less than four. The point is that the number of correction pulses may be determined so as to obtain a good display status.

Hereinbelow, an example of results of a display test performed by the aforementioned driving method 3 as in Example 1 will be described.

A VGA liquid crystal panel with the number of scanning lines L in one block of 120, the number of simultaneously selected scanning lines of 4, the response rate of 300 ms, and the number of pixels of 640×480×3 (RGB) was driven at a frame frequency of 150 Hz. The panel screen was divided into upper-half and lower-half portions for separate driving. The display shown in FIG. 17 was effected on the upper-half portion of the screen. The resultant brightness and the occurrence of shadowing obtained for the panel according to the present invention were compared with those for a panel where the present invention was not applied.

As a result, when the correction was performed, the difference in the brightness between points A and C was eliminated, compared with the case where no correction was performed. This prevented the occurrence of horizontal shadowing and uniform white background was realized. The occurrence of image doubling was also prevented by cutting the width of the selection pulse.

EXAMPLE 3

In Example 3, a scanning signal is corrected using a correction signal where both the pulse width and amplitude vary.

The liquid crystal display device of this example has substantially the same configuration as that of Example 1 shown in FIG. 1. In this example, a correction signal generating circuit 60 shown in FIG. 12 is used for the scanning driver control circuit 34 (FIG. 2).

Figure 12:
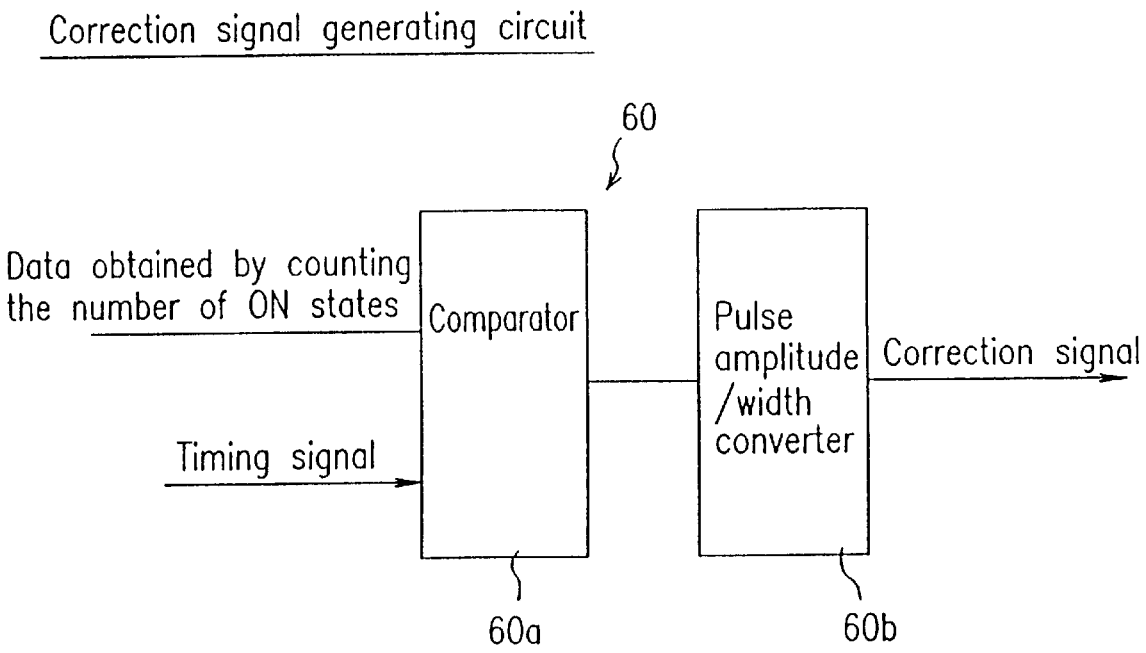
FIG. 12 is a block diagram of a circuit configuration of a correction signal generating circuit of the scanning driver control circuit of the liquid crystal display device of Example 3 according to the present invention.

The correction signal generating circuit 60 shown in FIG. 12 includes a comparator 60*a* which receives data obtained by counting the number of ON states supplied from the data count circuit 42 and a correction timing signal supplied from the timing generating circuit 41 and a pulse amplitude/width converter 60*b* for determining a pulse amplitude/width correction signal based on an output from the comparator 60*a*.

The correction signal generating circuit 60 generates the correction signal for correcting the pulse amplitude and the pulse width for obtaining a corrected voltage value corresponding to data relating to the number of pixels which are to be turned to the ON state lined along each scanning electrode at a timing corresponding to the correction timing signal.

The scanning driver in this example (not shown) has a circuit configuration where a circuit for temporally dividing the voltage correction signal is combined with the circuit of the scanning driver in Example 2.

The liquid crystal display device of this example with the above configuration is operated in the following manner. The input image data signal supplied from an external signal source is written in the memory 31 and read by an amount corresponding to the number of selected scanning electrodes in the column direction. Then, the orthogonal operation circuit 33 performs orthogonal operation of the image data signal read from the memory 31 and the orthogonal function generated by the function generating circuit 32. An output voltage of each data driver 51 is determined based on the results of the orthogonal operation.

Conventionally, only a voltage level determined based on the orthogonal function is used as the output of the scanning driver. According to the present invention, as one of the means for detecting the liquid crystal capacitance, the data count circuit 42 of the scanning driver control circuit 34 reads the image data signal from the memory 31 and counts the number of pixels where image data is to be supplied in the row direction. The correction signal generating circuit 60 of the scanning driver control circuit 34 outputs the pulse amplitude/width correction signal based on the counting results from the data count circuit 42. The scanning driver adds a desired amount of correction, i.e., a correction portion 2 shown in FIG. 13B, corresponding to the correction signal to the voltage level, to obtain an output voltage value.

According to the present invention, the width of the selection pulse can be reduced by stages. As shown in FIG. 13B, based on the control signal output from the pulse cutting signal generating circuit 44, the scanning driver outputs a signal where a predetermined period $Tk_1$ starting from the rising of the selection pulse and a predetermined period $Tk_2$ ending at the falling thereof are set at the non-selection voltage level. The scanning driver outputs not only the correction voltage value based on the number of pixels which are to be in the ON state (the correction portion 2 shown in FIG. 13B), but also a correction voltage for sharpening the rising of the actual pulse (a correction portion 1 shown in FIG. 13B).

Figure 13A:
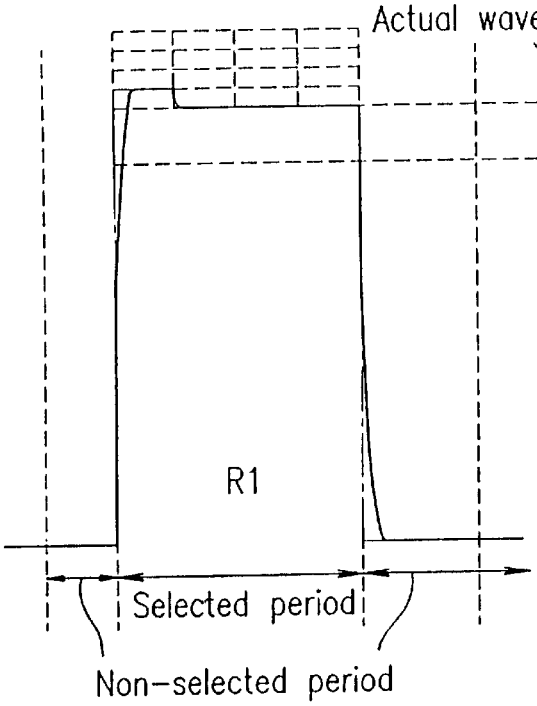
FIGS. 13A and 13B show actual waveforms of a selection pulse used in a driving method of the liquid crystal display device of Example 3.
Figure 13B:
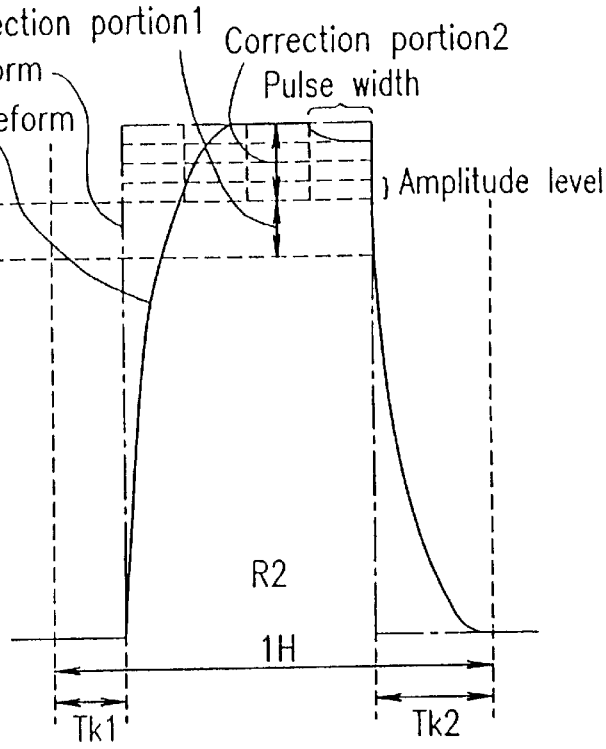

FIGS. 13A and 13B show waveforms of the actual selection pulses with an addition of a correction used when the display shown in FIG. 17 is effected. FIG. 13A is a waveform of the pulse applied to row R1 in FIG. 17, where a 1-amplitude level voltage is superimposed in the first time division of the 4-divided selected period. FIG. 13B is a waveform of the pulse applied to row R2 in FIG. 17, where a 4-amplitude level voltage is superimposed in the first three time divisions of the 4-divided selected period and a 3-amplitude level voltage is superimposed in the last time division thereof.

As will be understood from FIGS. 13A and 13B, the difference in the effective value of the pulse between rows R1 and R2 is small compared with the case where no correction is performed (FIGS. 18A and 18B). In this illustrative example, the four amplitude levels in the correction portion 2 have been previously divided into the four time divisions (time widths). The superimposition of the correction voltage in the correction portion 2 is preferably performed during a time division nearer to the rising of the selection pulse. The numbers of divisions in the pulse amplitude and width directions may be more than or less than four as in the illustrative example. The point is that the number of divisions may be determined so as to obtain a good display status.

Hereinbelow, an example of results of a display test performed by the aforementioned driving method 3 as in Example 1 will be described.

A VGA liquid crystal panel with the number of scanning lines L in one block of 120, the number of simultaneously selected scanning lines of 4, the response rate of 300 ms, and the number of pixels of 640×480×3 (RGB) was driven at a frame frequency of 150 Hz. The panel screen was divided into upper-half and lower-half portions for separate driving. The display shown in FIG. 17 was effected on the upper-half portion of the screen. The resultant brightness and the occurrence of shadowing obtained for the panel according to the present invention were compared with those for a panel where the present invention was not applied.

As a result, when the correction was performed, the difference in the brightness between points A and C was eliminated, compared with the case where no correction was performed. This prevented the occurrence of horizontal shadowing and uniform white background was realized. The occurrence of image doubling was also prevented by cutting the width of the selection pulse.

Thus, the present invention minimizes the shadowing in the panel horizontal direction caused by the difference in the electrical capacitance between a liquid crystal material in the ON state and that in the OFF state. Also, the present invention eliminates the image doubling due to dulling of the selection pulse, providing a good uniform display.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving method of a liquid crystal display device, of a matrix type including a plurality of scanning electrodes and a plurality of data electrodes, certain scanning electrodes being simultaneously selected and driven, wherein a correction voltage is added to a scanning signal to be supplied to the certain scanning electrodes, and further wherein the correction voltage has at least one pulse and a voltage obtained by adjusting a pulse width of the at least one pulse in accordance with the number of pixels on each scanning electrode which are to be in an ON or OFF state is used as the correction voltage to be superimposed on the scanning signal.

2. A driving method of a liquid crystal display device according to claim 1, wherein the scanning signal is in a non-selection voltage level before the scanning signal rises, and the scanning signal is in the non-selection voltage level after the scanning signal falls.

3. A driving method of a liquid crystal display device according to claim 2, wherein a voltage signal for sharpening the rising of the actual pulse is further added to the scanning signal.

4. A driving method of a liquid crystal display device, of a matrix type including a plurality of scanning electrodes and a plurality of data electrodes, certain scanning electrodes being simultaneously selected and driven, wherein a correction voltage is added to a scanning signal to be supplied to the certain scanning electrodes, and further wherein the correction voltage has at least one pulse and a voltage obtained by adjusting a pulse amplitude of the at least one pulse in accordance with the number of pixels on each scanning electrode which are to be in an ON or OFF state is used as the correction voltage to be superimposed on the scanning signal.

5. A driving method of a liquid crystal display device according to claim 4, wherein the scanning signal is in a non-selection voltage level before the scanning signal rises, and the scanning signal is in the non-selection voltage level after the scanning signal fails.

6. A driving method of a liquid crystal display device according to claim 5, wherein a voltage signal for sharpening the rising of the actual pulse is further added to the scanning signal.

7. A driving method of a liquid crystal display device, of a matrix type including a plurality of scanning electrodes and a plurality of data electrodes, certain scanning electrodes being simultaneously selected and driven, wherein a correction voltage is added to a scanning signal to be supplied to the certain scanning electrodes, and further wherein the correction voltage has at least one pulse and a voltage obtained by adjusting a pulse width and a pulse amplitude of the at least one pulse in accordance with the number of pixels on each scanning electrode which are to be in an ON or OFF state is used as the correction voltage to be superimposed on the scanning signal.

8. A driving method of a liquid crystal display device according to claim 7, wherein the scanning signal is in a non-selection voltage level before the scanning signal rises, and the scanning signal is in the non-selection voltage level after the scanning signal fails.

9. A driving method of a liquid crystal display device according to claim 8, wherein a voltage signal for sharpening the rising of the actual pulse is further added to the scanning signal.

10. A liquid crystal display device of a matrix type including a plurality of scanning electrodes and a plurality of data electrodes, comprising:

a detection section for detecting a liquid crystal capacitance of pixels corresponding to scanning electrodes which are to be in an ON or OFF state;

a section for obtaining a correction signal for adjusting at least one of a pulse width and a pulse amplitude based on a detection result from the detection section; and a section for adding a correction voltage obtained based on the correction signal to each scanning signal and supplying the resultant signal to each scanning electrode.

11. A liquid crystal display device according to claim 10, wherein the scanning signal is in a non-selection voltage level before the scanning signal rises, and the scanning signal is in the non-selection voltage level after the scanning signal falls.

12. A liquid crystal display device of a matrix type including a plurality of scanning electrodes and a plurality of data electrodes, comprising:

a detection section for detecting the number of pixels corresponding to scanning electrodes which are to be in an ON or OFF state;

a section for obtaining a correction signal for adjusting at least one of a pulse width and a pulse amplitude based on a detection result from the detection section; and a section for adding a correction voltage obtained based on the correction signal to each scanning signal and supplying the resultant signal to each scanning electrode.

13. A liquid crystal display device according to claim 12, wherein the scanning signal is in a non-selection voltage level before the scanning signal rises, and the scanning signal is in the non-selection voltage level after the scanning signal falls.

* * * * *